US009423200B1

(12) United States Patent
Fowler, IV

(10) Patent No.: US 9,423,200 B1
(45) Date of Patent: Aug. 23, 2016

(54) VIRTUAL PRELOADED BEARING

(71) Applicant: Robert Joseph Fowler, IV, Fredericksburg, VA (US)

(72) Inventor: Robert Joseph Fowler, IV, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/789,863

(22) Filed: Jul. 1, 2015

(51) Int. Cl.
*F16M 13/00* (2006.01)
*F41A 27/08* (2006.01)
*F41A 23/52* (2006.01)

(52) U.S. Cl.
CPC ..... *F41A 27/08* (2013.01); *F41A 23/52* (2013.01)

(58) Field of Classification Search
CPC ..... F41A 27/08; F41A 23/52; F41A 27/10
See application file for complete search history.

(56) References Cited

U.S. PATENT DOCUMENTS 515,018 A * 2/1894 Rapieff ..... F41A 27/08 89/37.01
2,396,247 A * 3/1946 Chadwick ..... F16C 35/06 384/562
2,410,614 A * 11/1946 Trotter ..... F41A 27/08 89/37.16
4,967,640 A * 11/1990 Dodd ..... F41A 27/08 89/37.03
6,276,260 B1 * 8/2001 Bianchi ..... F16J 1/18 92/187

* cited by examiner

*Primary Examiner* — Amy Sterling
(74) *Attorney, Agent, or Firm* — Gerhard W. Thielman Esq.

(57) ABSTRACT

A preload bearing is provided for mounting into an orifice in a shock-inducing platform. The bearing includes a cylindrical housing insertable into the orifice of the platform with a housing axis oriented vertically in relation to the platform, the housing having a closed bottom end and an open top end; a scraper that attaches to the bottom end of the housing for receiving compressive load from underneath; a crown roller disposed to extend radially from the housing; a shaft coaxial with the crown roller disposed within the housing along a roller axis perpendicular to the housing axis; and a cap that covers the open top end of the housing.

4 Claims, 5 Drawing Sheets

VIRTUAL PRELOADED BEARING

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to bearings for gun-mounts for shock absorption. In particular, the invention relates to a circumferential array of bearings, preloaded in a gun-mount to absorb recoil, thereby distributing stresses on the gun-mount and reducing overall mount deflection.

Conventional techniques for handling large radial loads involve tapered roller bearings. For example, hubs on automobile wheels use tapered roller bearings to withstand the radial load of such a motor vehicle traveling along a road. Other applications that experience a comparably slower spin rate, such as gun mounts, often employ the use of shims between a mount base and rotating yoke base. As a gun recoils, the radial load transmits through the yoke base into the central azimuth bearing and shims into the mount base.

A disadvantage to this configuration is that the shims do not permit a very stiff joint. As a result, rocking between the shim and the mount base is evident and can lead to high wear rates. One obvious solution involves drastically increasing the size of the azimuthal bearing to minimize deflection from the radial gun fire loads. However, this approach also imposes severe weight and manufacturing constraints.

Conventional techniques for detecting fatigue defects in gun and mortar mounts include inspection of the system after a given number of firings, with mean time between failure being calculated theoretically. With the advent of finite element analysis, theoretical computation of fatigue and mean times between failures has greatly improved. However, due to the complexity of some systems, empirical data provides a more accurate determination of fatigue life.

Outside of gun and mortar mounts, empirical fatigue testing has been conducted for over half a century. This has been limited to material samples, consisting of varying materials, tempers, and environmental conditions. Recently with the increased capability of servo motors and computer control, entire mechanical systems have undergone system level fatigue testing.

SUMMARY

Conventional load bearing systems yield disadvantages addressed by various exemplary embodiments of the present invention. In particular, a preload bearing is provided for mounting into an orifice in a shock-inducing platform. The bearing includes a cylindrical housing insertable into the orifice of the platform with a housing axis oriented vertically in relation to the platform, the housing having a closed bottom end and an open top end; a scraper that attaches to the bottom end of the housing for receiving compressive load from underneath; a crown roller disposed to extend radially from the housing; a shaft coaxial with the crown roller disposed within the housing along a roller axis perpendicular to the housing axis; and a cap that covers the open top end of the housing.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
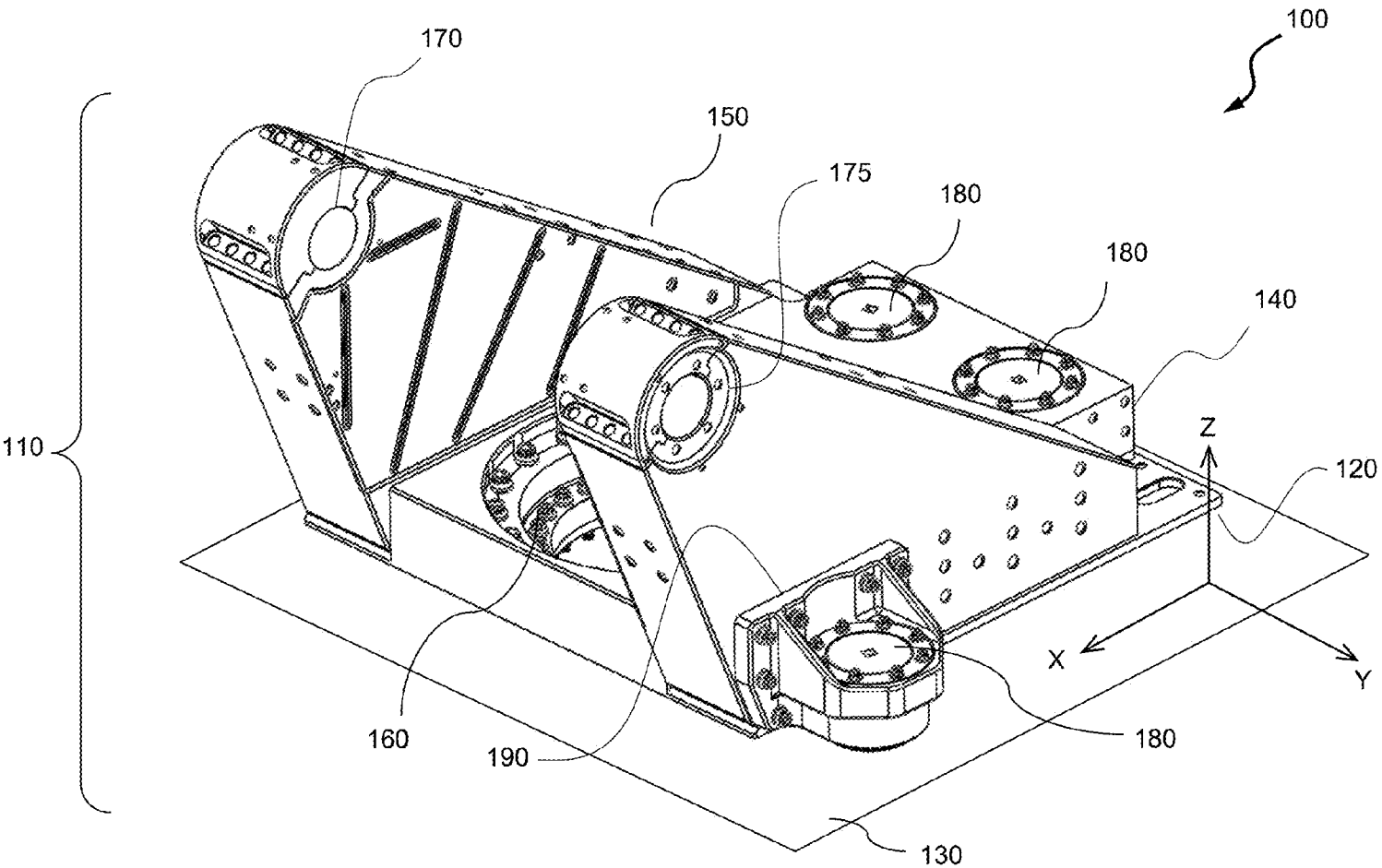
FIG. 1 is a isometric view of a load mount.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Exemplary embodiments described herein provide a trainable gun-mount with increased stiffness as compared to conventional designs, thereby improving weapon accuracy. Additional advantages include improving load dispersion throughout and maintainability of the trainable gun-mount, as well as decrease the gun-mount's weight. Accordingly, the gun-mount includes a yoke base affixed to a central bearing. The yoke base includes a pair of trunnions from which gunfire recoil force imparts into uprights of the yoke.

In these embodiments, a series of roller bearing assemblies with crowned rollers are circumferentially mounted to the yoke base equidistant from the central bearing. These roller bearing assemblies are installed from the top of the yoke base to aid in maintenance. After installation, axial loads imposed on the roller bearing assemblies impart a preload between the yoke base and the mount base while they remain affixed via the central bearing, thereby improving load distribution. Stiffness substantially increases between the yoke base and the mount base as compared to conventional designs, thereby improving gunfire accuracy.

The purpose of these embodiments is to minimize deflection and weight in a bearing assembly that experiences transient radial loads, such as impulse shocks. This is accomplished by redistributing radial loads imparted on a central bearing across concentrically mounted roller bearing devices that are preloaded after installation, thereby increasing the overall stiffness of the assembly. The radial loads are dispersed across a larger area of contact thus lowering the load requirement of the central bearing, increasing stiffness of the assembly and decreasing overall system weight as compared to a single larger bearing of equivalent stiffness.

Thus a simple light weight design is desired to disperse the radial load from the central bearing while increasing stiffness and decreasing weight. Additional benefits from this design include simplified maintenance, as the roller bearing devices have ready accessibility for removal and do not require complete disassembly of the gun-mount system. The resulting design is the virtual preloaded bearing; named "virtual" for replacing a much larger single bearing with a central bearing and a distributed series of smaller roller bearing devices that provide the same functionality. The exemplary design provides the distinct advantage over previous designs of being lighter, stiffer and easier to maintain. By contrast, larger bearings of equivalent stiffness are costly and heavy, and shims provide poor stiffness to the assembly, as well as being difficult to replace and maintain.

FIG. 1 shows an isometric assembly view 100 of a mount base 110 for gun or mortar. A mount base 110 has a pair of mount plates 120 on a flat platform 130 that flank a gun yoke base 140 therebetween. The plates 120 support parallel yoke upright arms 150. The platform 130 defines axial (X) and lateral (Y) directions, and is perpendicular to the vertical (Z) direction. The yoke base 140 includes a central bearing 160 in a turret well for disposing the gun (not shown).

Force load is applied to a pair of trunnions 170 disposed on each yoke upright arm 150. The trunnions 170 are incorporated within horizontal bearings 175. The platform 130 includes a pair of exemplary virtual preloaded bearing devices 180. The central bearing 160 pivots in pitch, i.e., rotating in the lateral (Y) axis. In addition, each yoke upright arm 150 includes an exemplary bearing device 180 attached by a bracket 190. The bearing devices 180 are substantially equidistant from the center of the central bearing 160 to more ideally distribute preload forces, whether disposed on the yoke base 140 or in the brackets 190.

Figure 2:
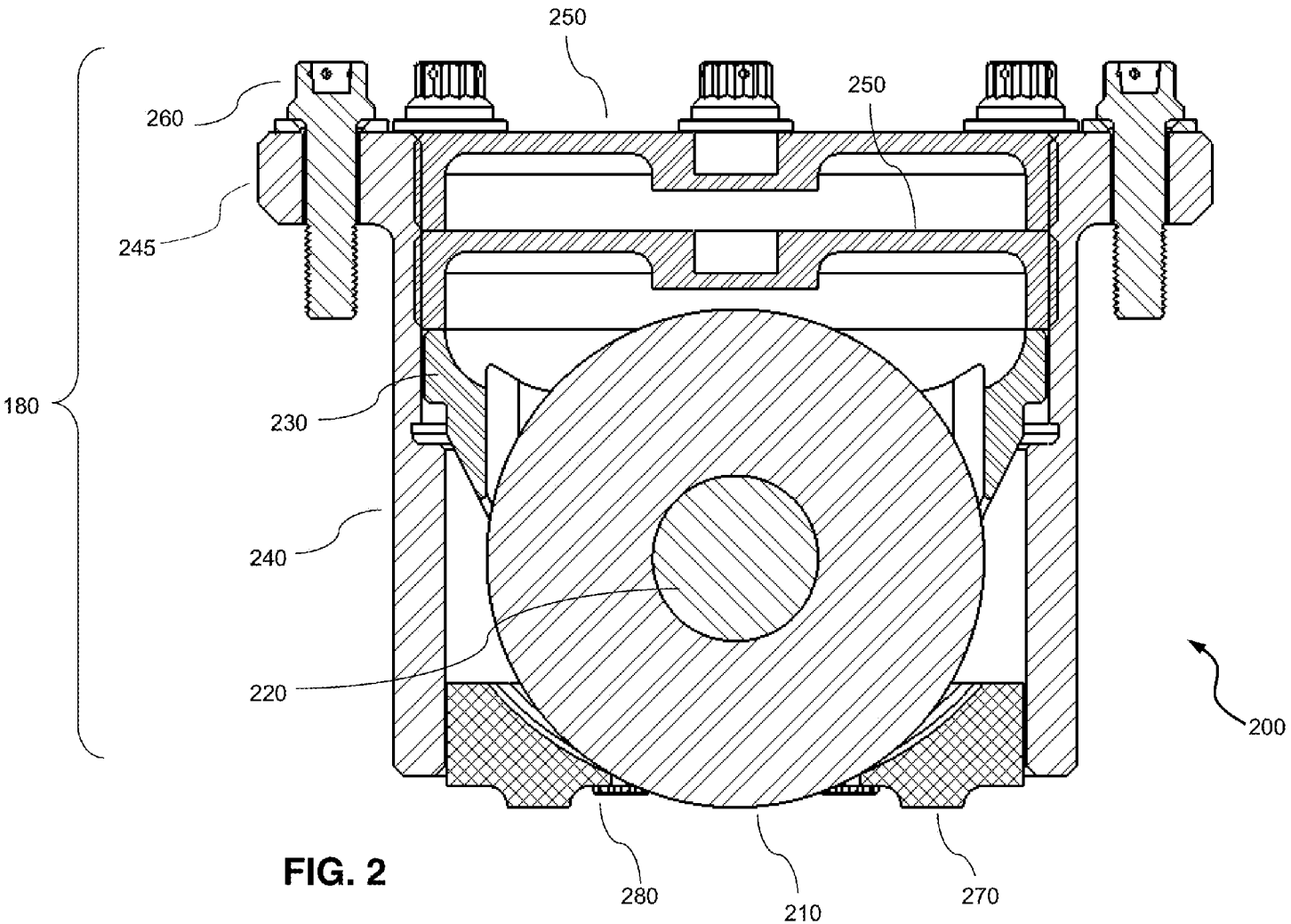
FIG. 2 is an elevation cross-section view of an exemplary preloaded bearing.

FIG. 2 shows an elevation cross-section assembly view 200 of an exemplary configuration for the preloaded roller bearing device 180. A sealed crown roller bearing 210 fits onto a cylindrical shaft 220. These bearings 210 press into two corresponding holes of a yoke 230. This sub-assembly fits into a housing 240 having an attachment lip 245 at its top. A pair of threaded caps 250 double nut the yoke 230 inside the housing 240 and provide the necessary torque via the drive socket located on top of the caps 250. The housing 240 attaches to the mount base 110 by screws 260 that pass through the lip 245. A scraper 270 fixes to the bottom of the housing 240 with screws 280. The scraper 270 clears the contact surface of the platform 130 for the crowned roller bearing 210.

Figure 3:
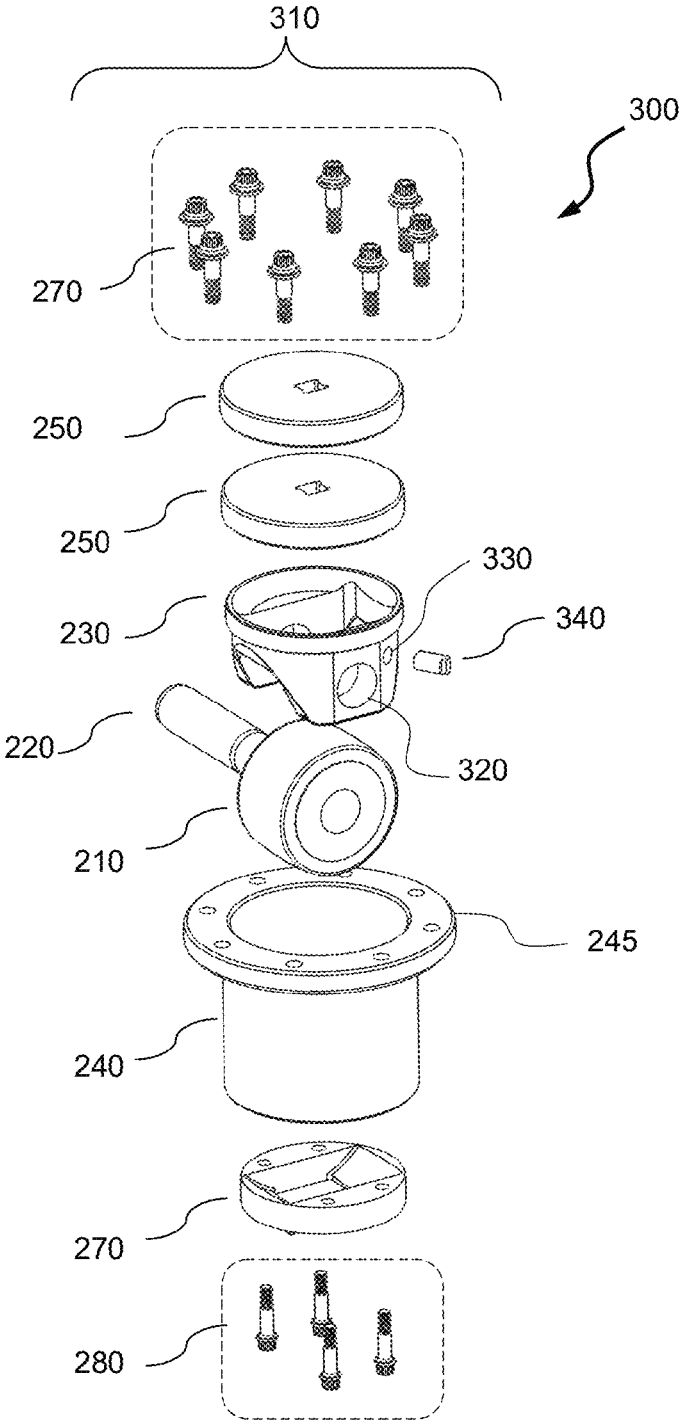
FIG. 3 is an isometric exploded view of the preloaded bearing.

FIG. 3 shows an isometric exploded view 300 of exemplary bearing components 310. The yoke 230 includes a first opening 320 for receiving the shaft 220 and a second opening 330 for receiving an alignment pin 340 for insertion therein. The common axis of the shaft 220 and yoke 230 through the first opening 320 is perpendicular to the longitudinal axis of the housing 240. The pin 340 aligns the yoke 230 in the second opening 330 of the housing 240. The concatenated caps 250 cover the open top of the housing 240 within the lip 245, and the scraper 270 attaches at the bottom of the housing 240.

Figure 4:
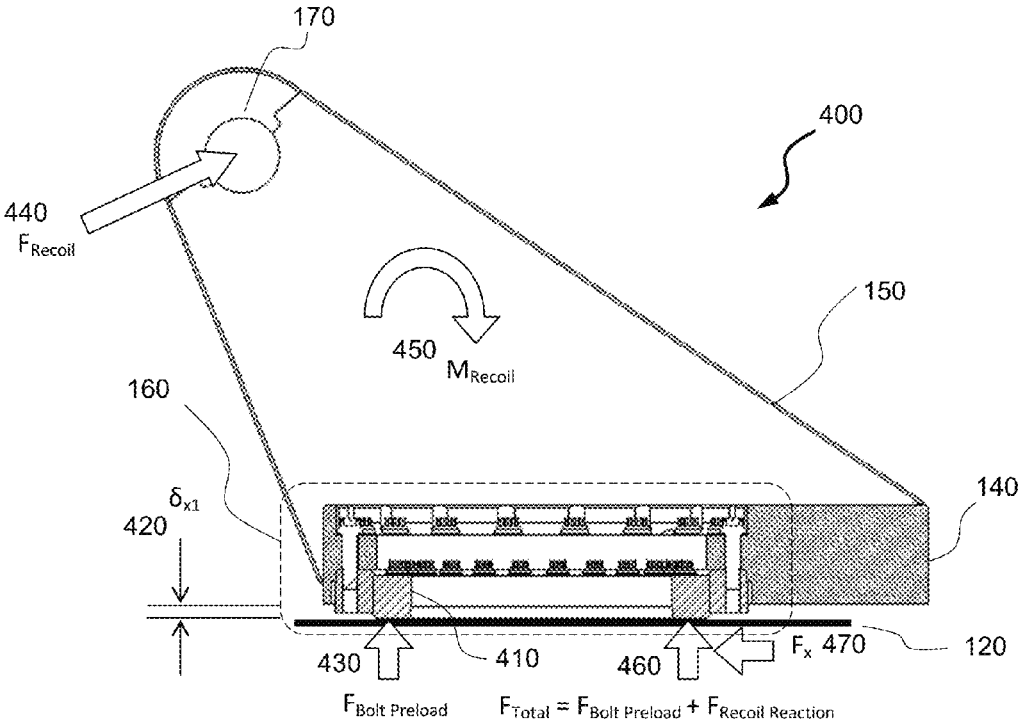
FIG. 4 Related Art
FIG. 4 is an elevation cross-section view of a conventional load mount featuring a central bearing.

FIG. 4 shows an elevation cross-sectional view 400 of a conventional mount base 110 with load distribution. The central bearing 160 in the yoke base 140 is shown disposed on the mount base 110 supported on proximal and distal bolts 410. A first vertical gap $\delta_{x1}$ 420 represents the distance between the flat platform 120 and the yoke base 140. A bolt preload force 430 in the vertical (Z) direction at the proximal bolt 610 secures the yoke base 140 to the mount base 110. A recoil force 440 applied at the trunnions 170 induces a recoil moment 450 through the yoke upright arm 150. The recoil force operates substantially in the axial (X) direction, with the recoil moment induces pitch motion involving the recoil force operating a vertical (Z) distance between the trunnions 170 and the platform 120. A total force 460 at the distal bolt includes the preload and recoil forces. The distal bolt 410 also receives horizontal force 470 in the axial (X) direction.

Figure 5:
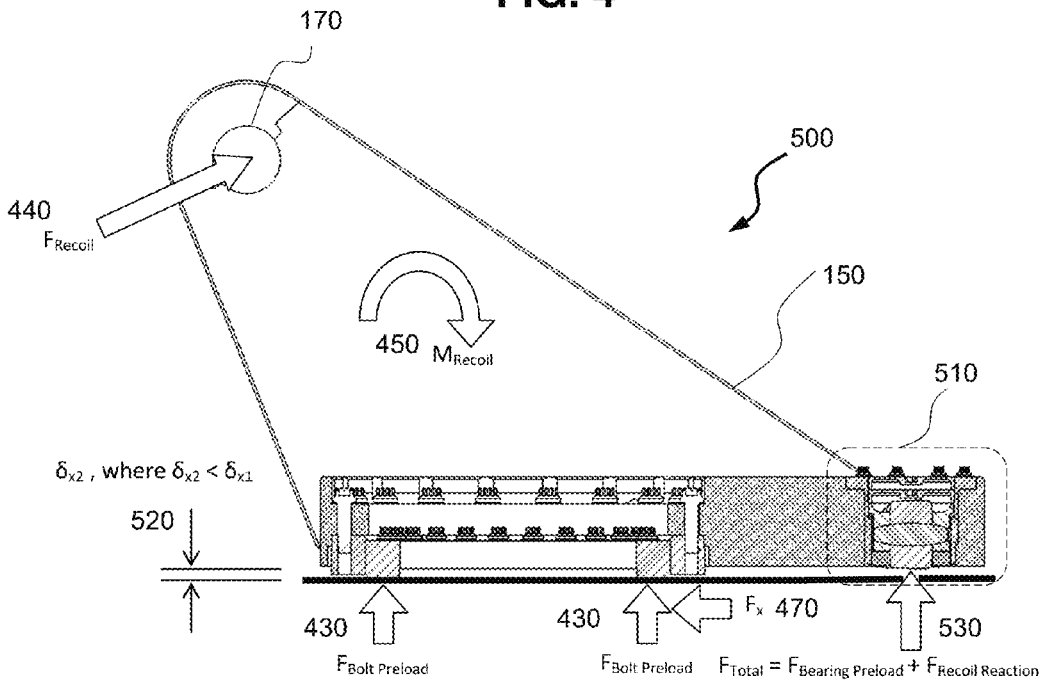
FIG. 5 is a first elevation cross-section view of the exemplary load mount with preloaded bearings.

FIG. 5 shows an elevation cross-sectional view 500 of a mount base 110 with a preload installation flange 510 that includes one of the roller bearing devices 180 in the yoke base 140. A second vertical gap $\delta_{x2}$ 520 denotes the vertical distance between the flat platform 120 and the mount base 110. The second vertical gap 520 is smaller than the first vertical gap 430. The mount base 110 provides a first exemplary load distribution with the roller bearing devices 180 on the yoke base 140. The proximal and distal bolts 410 receive respective (and equivalent) preload forces 430. A bolt in the installation flange 510 receives a total force 530 from the preload and recoil forces.

Figure 6:
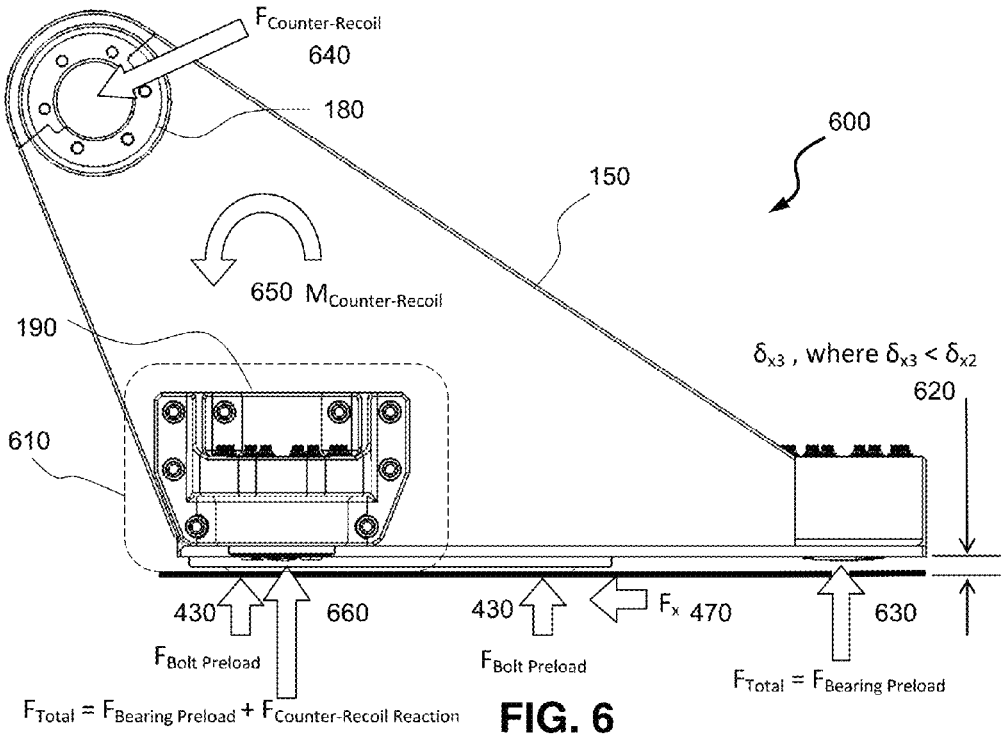
FIG. 6 is a second elevation cross-section view of the exemplary load mount with preloaded bearings.

FIG. 6 shows an elevation cross-sectional view 600 of the mount base 110 with a second exemplary load distribution with the roller bearing devices 180. A mounting assembly 610 on each yoke upright arm 150 includes the bracket 190 and its associated roller bearing device 180. A third vertical gap $\delta_{x3}$ 620 represents the distance between the flat platform 120 and the yoke base 140. The third vertical gap 620 is larger than the second vertical gap 520.

The preload forces 430 are applied to the bolts 410. An additional load 630 is applied to the roller bearing device 180 at the installation 510. A counter-recoil force 640 on is applied to the trunnions 170 to produce a counter-moment 650. This produces a compensating load 660 at the mounting assembly 610. These combined counter recoil reaction forces 630 and 660 compensate for the forces transmitted by applied counter-recoil force 640 and thereby reduce rocking motions on such mounting systems.

Figure 7:
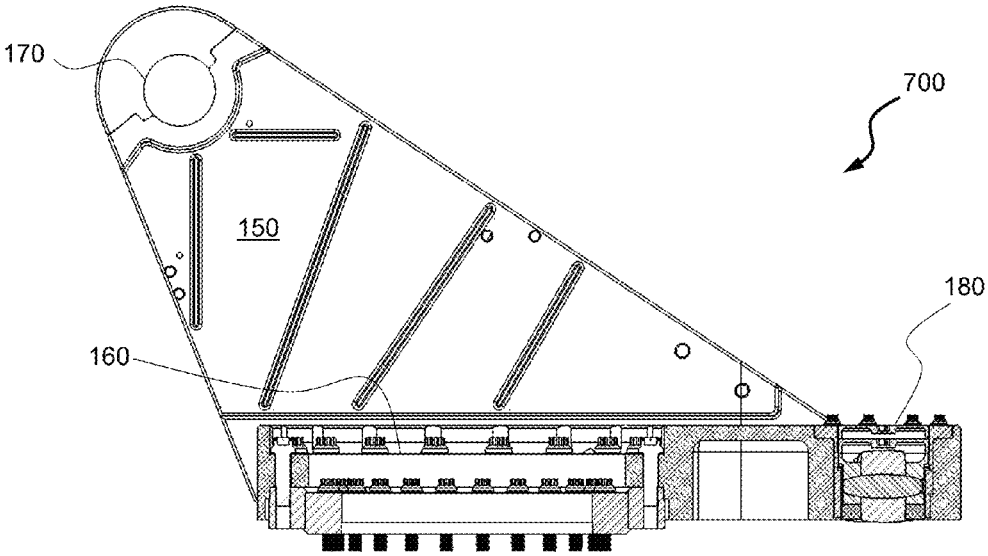
FIG. 7 is an elevation cross-section view of the load mount.

FIG. 7 shows an elevation view 700 of the yoke upright arm 150 from a bilateral midline between the span of the loading rod (not shown) along the lateral (Y) direction. The central bearing 160 and the roller bearing device 180 at the installation 510 are also shown. The roller bearing devices 180 are located substantially equidistant from the central bearing 160. The yoke base 140 connects the loading rod (not shown) to the mount base 110. The exemplary bearing devices 180 are torqued inducing a preload between the mount base 110 and the yoke base 140; thereby preventing loss of contact between the roller bearing devices 180 and the mount base 110 during radial loading force 640 at the trunnions 170.

The Virtual Preloaded Bearing Assembly is applicable to any situation involving a bearing with a high radial load and low revolutions per minute. This setup reduces overall system weight while maintaining equivalent stiffness response. Obvious applications include gun mounts.

The exemplary design was conceived for use on the Dragon Fire 105 mm Trainable Gun Mount (TGM) Demonstration Program for the U.S. Air Force to reduce deflection in the mount and simultaneously reducing weight. This design has immediate use for the Ghostrider AC-130J and Stinger II AC-130W Gunship 105 mm TGMs and can be retrofitted on the 30 mm TGM to increase stiffness. The Virtual Preloaded Bearing has utility not only on gun mounts but on all other applications involving bearings experiencing radial load and low revolutions-per-minute in which stiffness and weight are of concern.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A virtual preloaded bearing device for mounting into an orifice in a shock-inducing platform, said bearing device comprising:

a cylindrical housing insertable into the orifice of the platform with a housing axis oriented vertically in relation to the platform, said housing having a closed bottom end and an open top end;

a scraper that attaches to said bottom end of said housing for receiving a compressive load along said housing axis;

a crown roller disposed to extend radially from said housing;

a shaft coaxial with said crown roller disposed within said housing along a roller axis perpendicular to said housing axis; and a cap that covers said open top end of said housing.

2. The preload bearing according to claim 1, wherein said cap includes a plurality of concatenated caps.

3. The preload bearing according to claim 1, said open top end includes a lip that extends radially from said housing, and upper screws secure said cap to said lip.

4. The preload bearing according to claim 1, wherein lower screws secure said scraper to said housing.

* * * * *